United States Patent [19]

Kowall et al.

[11] 4,230,227

[45] Oct. 28, 1980

[54] SHIPPING CONTAINER

[75] Inventors: James L. Kowall; Paul M. Taylor, both of Grand Rapids, Mich.

[73] Assignee: Powerpak, Inc., Grand Rapids, Mich.

[21] Appl. No.: 84,970

[22] Filed: Oct. 24, 1979

[51] Int. Cl.[3] ..... B65D 6/26; B65D 19/20

[52] U.S. Cl. ..... 206/600; 217/12 R; 217/15; 217/43 A; 217/65; 229/23 C

[58] Field of Search ..... 217/12 A, 43 A, 65, 217/12 R, 15, 47; 229/41 R, 23 C, 41 B; 206/600, 386

[56] References Cited

U.S. PATENT DOCUMENTS

| | | | |
|---|---|---|---|
| 2,022,538 | 11/1935 | Colbie | 217/12 A |
| 2,481,855 | 9/1949 | McKenzie | 229/23 C |
| 2,982,462 | 5/1961 | Sharp et al. | 229/23 C |
| 3,147,908 | 9/1964 | Clemens . | |
| 3,148,821 | 9/1964 | Gardiner | 229/41 R |
| 3,237,839 | 3/1966 | Wiley . | |
| 3,294,306 | 12/1966 | Areddy . | |
| 3,346,136 | 10/1967 | Osborn | 217/12 R |
| 3,494,535 | 2/1970 | Acker | 217/43 A X |
| 3,514,030 | 5/1970 | Carroll . | |
| 3,583,626 | 6/1971 | Overton et al. | |
| 3,688,968 | 9/1972 | Rathfon . | |
| 3,727,786 | 4/1973 | Fausel | 229/23 C |
| 3,949,874 | 4/1976 | Heavner | 229/23 C X |
| 4,054,223 | 10/1977 | Marques | 217/43 A X |

*Primary Examiner*—Allan N. Shoap

*Attorney, Agent, or Firm*—John E. McGarry; Richard A. Gaffin

[57] ABSTRACT

A folding container construction has a wooden reinforcing framework which is attached to the side (74, 75) and end walls (98, 99) of the box. The side walls (74, 75) of the box are provided with vertical struts (82, 84, 86) disposed at the peripheral edges of the walls and a single, horizontal brace (79, 80) disposed adjacent to the top of the wall. At least one horizontal reinforcing member (104, 105) is provided on each end wall of the box with the horizontal members being received by slots defined by the struts on the side walls and the horizontal brace to maintain the box configuration. The end walls (98, 99) are maintained on the base (60) of the container by the bottom surfaces of the vertical struts which seat against a bottom flap (92, 93) on the end walls when the box is constructed. In this way, the need for separately attaching the end walls to the container base is eliminated. In one embodiment of the invention, a score line (76, 77) may be provided on one side wall to allow for folding of the wall outwardly to facilitate loading of the container.

21 Claims, 8 Drawing Figures

SHIPPING CONTAINER

BACKGROUND OF THE INVENTION

1. Field of the Invention

The present invention relates to reinforced, foldable containers for use in shipping objects and the like.

2. State of the Prior Art

When packing articles to be shipped in trucks, for example, it is convenient to use large-sized containers which are mounted on skids or pallets. The containers are typically used to pack relatively large or heavy objects, which may include such automotive parts as fenders, for example. Typically, the large containers are often manufactured from corrugated board providing a relatively lightweight shipping box which reduces the cost of transporting articles. In view of the size of the containers and the objects to be transported in them it is often necessary to provide reinforcing members within the structure. Additionally, the cost of a corrugated board container is relatively less expensive than that of a comparable size wooden container which has in the past been used to transport heavy articles.

Since the containers are often mounted on skids or pallets, the base of the box may have dimensions of five feet by seven feet. Thus, it is convenient to have a box which is foldable so as to reduce the volume which the box take up when it is stored. Such folding box constructions are well known in the prior art and have been used with great success for transporting large or heavy articles.

U.S. Pat. No. 3,514,030, issued May 26, 1970, discloses a shipping container constructed of corrugated board having a base which is secured to a pallet and foldable side walls. The side walls carry posts in which slots are provided for insertion of the end walls of the container. If it is desired to store the box in a collapsed form, the end walls must be removed from the posts.

Another typical box construction is disclosed in U.S. Pat. No. 3,583,626, issued June 8, 1971, in which a cardboard box is provided with a reinforcing frame at its end portions. The frame includes a generally rectangular assembly having side cleats attached to the side walls and top and bottom cleats secured to respective top and bottom flaps. No horizontal reinforcement is provided on the end walls of the container.

The container configuration disclosed in U.S. Pat. No. 3,147,908, issued Sept. 8, 1964, employs reinforcing members provided at the corners and horizontally along the side walls of the box. Other known containers include reinforcement members attached to walls which are themselves independently secured to the base or formed integrally with the base portion.

It is desirable to provide a corrugated board container having an interlocking framework which reinforces the box structure and which permits collapsing of the box for storage. Such a framework strengthens the individual walls of the container while providing a substantially rigid framework for the entire container assembly. In order to provide the desired strength in a collapsible container, the framework must be arranged in a particular interlocking relationship.

DESCRIPTION OF THE INVENTION

According to the inventor, a container has a base which is secured to a pallet or skid. A pair of side walls are secured to the base, with the walls being foldable along a score line along the base. A pair of end walls which are also foldable into an upright position complete the container interior. The end walls are provided with at least one horizontal reinforcing member and the side walls include vertically-arranged struts spaced along the length of the side wall and a horizontal strut along the top of the wall. The vertically-arranged struts form slots into which the horizontal reinforcing members are received when the box is assembled to define an interlocking frame structure.

In a second embodiment, two horizontal members are provided on the end walls. The horizontal strut on the side walls and the top surfaces of the vertical struts define slots into which the two members on the end wall are received. A score line may be provided at the midportion of one side wall to permit folding of the wall to facilitate loading of the container.

The walls of the container may include score lines which permit folding of the walls to a collapsed position. The score lines are typically spaced from the base a distance at least equal to the width of a strut so that the wall lies flat on the base when collapsed. In this way, storage of the container is facilitated.

The walls of the container are secured in an upright position by stapling the end walls to the vertical struts, inserting locking pins through the reinforcing members, or strapping the walls in place.

Accordingly, the invention provides an improved box structure which has a reinforcing frame for providing added strength to the container. The containers are well suited for shipping large automotive parts such as fenders. When the box is assembled, the reinforcing members form a tongue-and-groove arrangement which rigidifies and maintains the box shape. The vertically-arranged supports also maintain the end walls in place on the base of the container, thereby eliminating the need for separately attaching the end walls to the base.

By providing separately attached end and side walls, the dimensions of the container can be readily varied. Various end and side walls can be interchangeably used with different size bases to form a container having desired dimensions. Since the elements of the box are all relatively flat, the space needed to store the box is minimized. Additionally, the end and side walls of the container are foldably mounted on the base to further reduce the storage space needed with the box is assembled.

The reinforcing structure for the container is typically formed of wooden slats arranged in the above-described relationship to assemble the box in the desired shape. This interlocking relationship provides the necessary strength to the container while minimizing the weight of the box.

BRIEF DESCRIPTION OF THE DRAWINGS

The invention will be described with reference to the drawings in which like members bear like reference numerals wherein.

DETAILED DESCRIPTION OF THE PREFERRED EMBODIMENT

Figure 1:
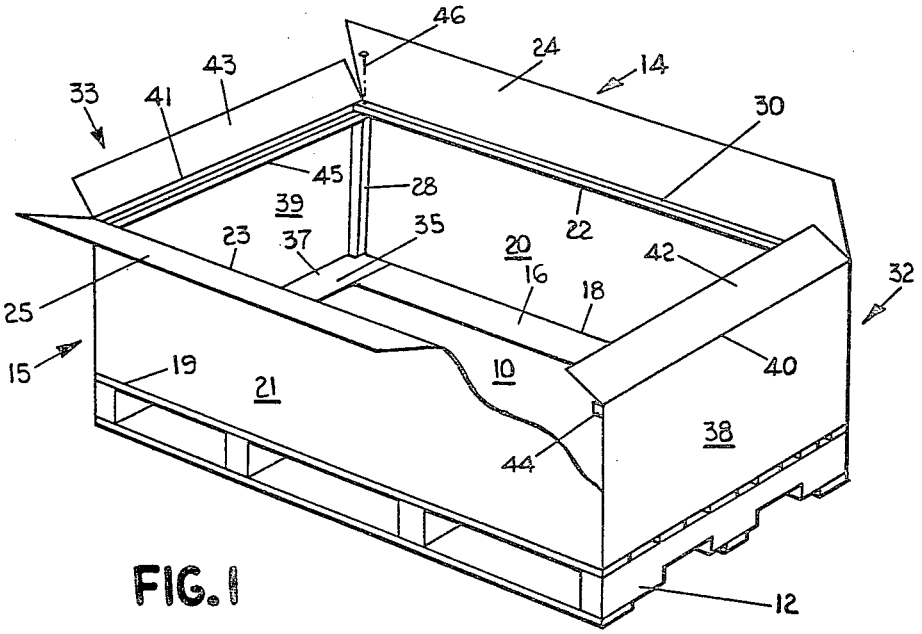
FIG. 1 is a perspective view of one embodiment of an assembled box with one of the side walls partially cut away.

With reference to FIG. 1, an assembled box is shown in accordance with a first embodiment of the invention. The box has a base 10 which is typically formed of corrugated board and is attached to a skid or pallet 12 to facilitate loading into a truck or other shipping vehicle. Openings are provided in the skid to receive the tines of a fork lift truck.

The box includes two integral side panels 14, 15 each having a score line 18, 19 which defines a bottom flap 16, 17. The side panels 14, 15 include a wall 20, 21 which is foldable along the score line 18, 19 into an upright position. Score line 22, 23 extend horizontally across the side panels parallel to score lines 18, 19 to define a top flap 24, 25. The top flap 24, 25 is also foldable downwardly along the score lines to provide a cover for the container.

A pair of vertically arranged struts 26, 28 are secured to the inner peripheral edges of the side walls 14 to form a part of a reinforcing structure for the container. Likewise, side panel 15 is provided with vertical struts 27 and 29 which are secured to the peripheral edges of the side wall. Each side panel is also provided with a horizontally extending brace 30, 31 disposed adjacent the score line 22, 23 near the top flap. The vertical struts are slightly spaced from the horizontal braces in order to define a slot for receiving a cooperating member of the reinforcing frame which will be described later.

End panels 32, 33 are disposed perpendicularly to the side walls in order to define the interior of the container. Horizontally extending score lines 36, 37 define a bottom flap 34, 35 on each end panel. Walls 38, 39 are foldable along the score lines 36, 37 into an upright position when the box is assembled. At the top portion of the end panel 32, 33 are score lines 40, 41 which define a top flap 42, 43 for providing a cover on the container. Each end panel is provided with a horizontally extending brace 44, 45 disposed at the top portion of the wall 38, 39 and spaced from the score line 40, 41.

Figure 2:
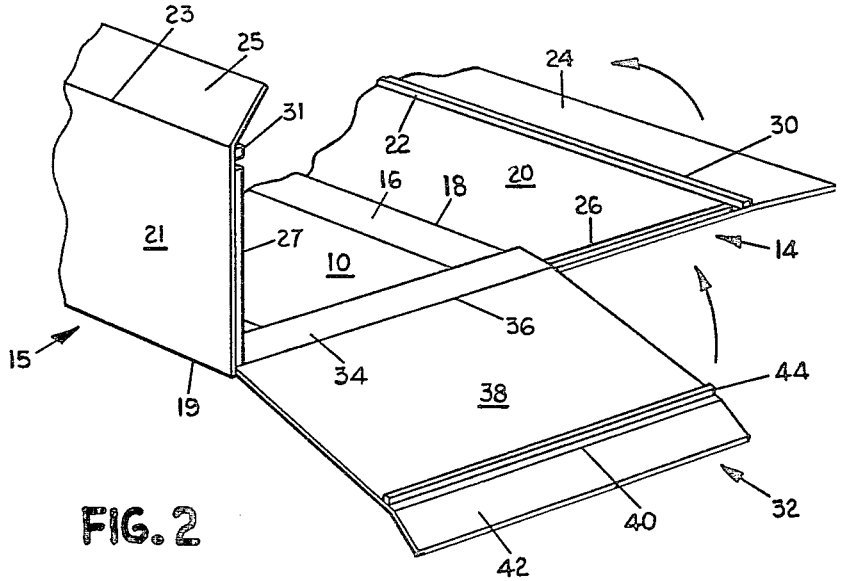
FIG. 2 is a partial perspective view of an end of the box according to FIG. 1 showing the method of assembling the box into its final configuration.

With reference to FIG. 2, the manner of assembling the box is shown. The side panels 14, 15 are arranged adjacent to the base 10 which may be secured to a skid or pallet 12. The bottom flaps 16 and 17 overlie the edges of the base and are stapled thereto. The end panels 32 and 33 are then placed along the remaining two sides of the base so that the bottom flaps 34 and 35 overlap the base 10 and the bottom flaps 16 and 17 of the side panels. The walls of the side and end are then folded upwardly into place as shown by the arrows in FIG. 2 to form the interior of the container. When the walls are upright, the horizontal braces 44 and 45 on the end panels are received within the slots defined between the vertical struts and the horizontal members on the side walls, thereby providing an interlocking reinforcing structure for the container. The bottom surfaces of the vertical struts attached to the side walls 20, 21 seat against the bottom flaps 34 and 35 on the end panels to retain the end panels on the skid. In this way the need for separately attaching the end panels to the skid is eliminated. If it is desired to permanently attach the end panels to the base, staples or the like may be used.

Figure 7:
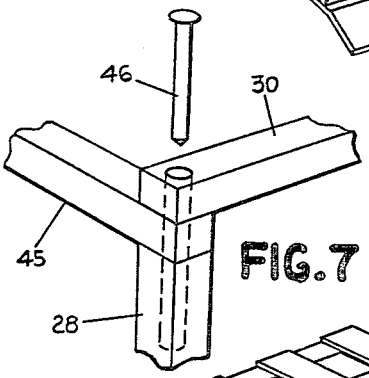
FIG. 7 is a perspective view of a locking pin arrangement for securing the walls in place.

The walls of the side and end panels of the container are typically maintained in an upright position by securing the vertical and horizontal reinforcing members to each other. This may be done by driving a staple through the adjacent reinforcing members or inserting a locking pin through bores within the vertical and horizontal members, as shown in FIG. 7. Other means for retaining the panels in an upright position include providing a strap (not shown) about the periphery of the box, for example.

Figure 3:
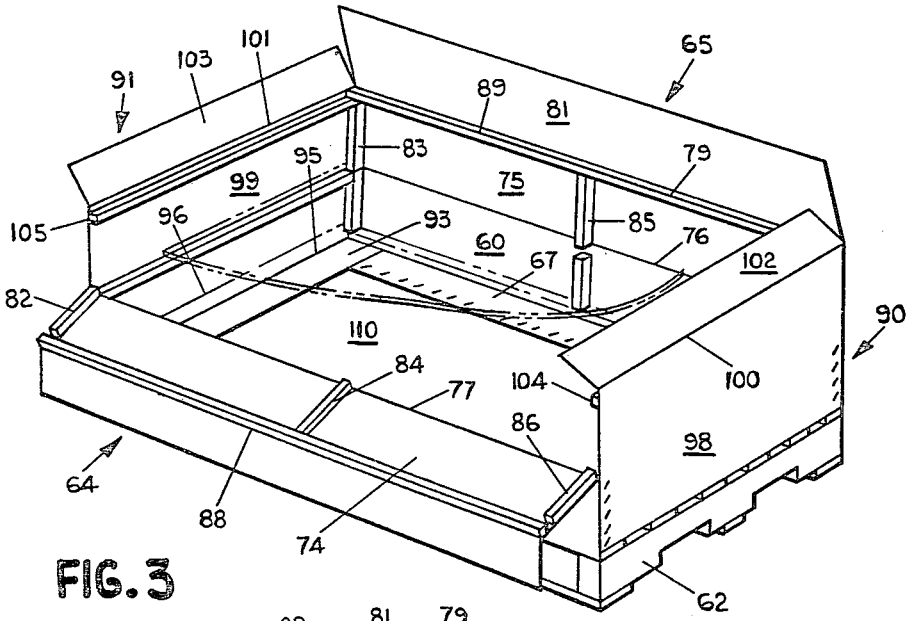
FIG. 3 is a perspective view of a second embodiment of an assembled box with one of the side walls folded back.
Figure 4:
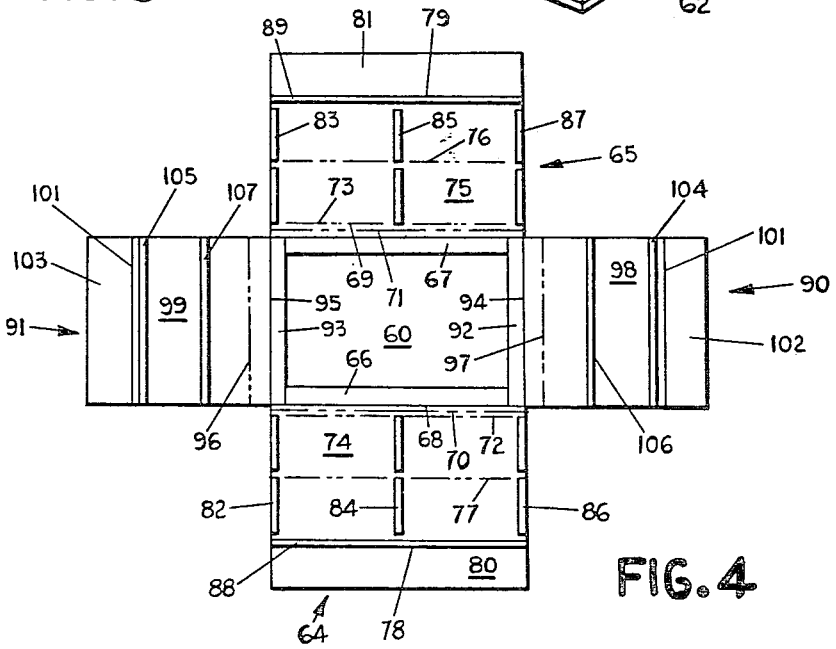
FIG. 4 is a view of the bottom, side and end walls of the box according to FIG. 3 displayed in their relative positions before assembly of the container.

A second embodiment of the invention is shown in FIG. 3 wherein the container includes a base 60 on which pairs of side panels 64 and 65 and end panels 90 and 91 are placed. The base 60 is typically secured to a skid 62 as described above in reference to the first embodiment of the invention.

The side panels 64 and 65 of the container each include a score line 68, 69 which defines a bottom flap 66, 67 of the panel for securing the side panel to the base. A second score line 70, 71 is spaced from the first score line/and a third score line 72, 73 parallel to and spaced from the second score line is provided horizontally across the bottom of the side panel to provide a means of folding the panel downwardly when the box is to be stored, as will be discussed below. The side panels include walls 74 and 75 wich are foldable along the score lines 68, 69 into either an upright or collapsed position.

The midportion of each wall 74, 75 is typically provided with a score line 76, 77 which enables the wall to be folded down to half its height in order to facilitate loading of the container, for example. The side panels also include a top flap 80, 81 defined by a score line 78, 79 for providing a cover for the container.

Each side wall 74, 75 is provided with vertical struts 82, 84, 86 for reinforcing the side panel. The vertical struts are typically wooden slats approximatly 2×2 inches in cross-section and are formed in two pieces, each of which is disposed on an opposite side of the central score line 76, 77 and spaced therefrom. In this way, the folding of the side wall 74, 75 along the midportion thereof is facilitated. The spacing between the members of the vertical struts about the score line defines a slot in which a reinforcing member carried on the end panel is received, as will be discussed. The top portion of each side wall 74, 75 carries a horizontally-extending member 88, 89 disposed adjacent the top score line 78, 79. The vertical struts disposed at the corner portions of the side walls are vertically spaced from the bottom surface of the horizontal member 88, 89 in order to define a slot for involving a cooperating reinforcing member. The vertical struts at the central portion of the side walls abut the adjacent surface of the horizontal member.

Integrally formed end panels 90, 91 complete the container construction. The end panels 90, 91 include a first score line 94, 95 which defines a bottom flap 92, 93. A second parallel, spaced score line 96, 97 allows for folding of the panel into a collapsed position. Walls 98 and 99, which are foldable alone the score line 94, 95, define the end portions of the box and include a top flap 102, 103 defined by score lines 100 and 101.

Horizontally extending braces 104 and 105 are provided adjacent the top portion of the end walls 98, 99 and are slightly spaced from the score lines 100, 101. A second reinforcing member 106, 107 is provided at the midportion of the end walls to provide for further reinforcement of the container.

Figure 5:
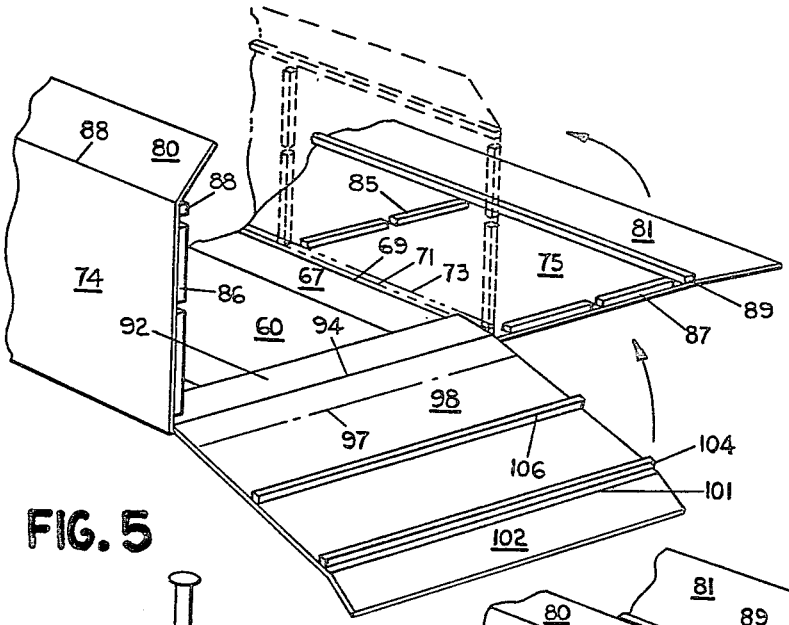
FIG. 5 is a partial perspective view of an end of the box of FIG. 3 showing the method of assembly.

The construction of the container is similar to that described above with reference to the first embodiment of the invention. As shown in FIG. 5, the side panels 64, 65 are first laid upon the base 60 and stapled into place, for example, and the end panels 90, 91 are arranged so as to overlay the bottom flaps 66, 67 of the side panels and the base 60. The side and end walls are then folded into an upright position so as to form the interior of the container with the bottom flaps 92, 93 of the end panels being disposed under the vertical struts arranged in the corners of the side walls. Due to the large size of the container it may be desirable to further secure the end panels in place by stapling the bottom flaps to the base. When the end and side walls are pivoted into an upright position, the horizontal braces on the end walls are received in the slots defined by the reinforcing members provided on the side walls. The tongue-and-groove arrangement of the reinforcing frame provides a relatively sturdy container while minimizing construction costs. The end and side panels are typically prefabricated with the reinforcing members so that construction of the box is relatively simple. It is only necessary to arrange the side and end panels in the desired configuration and then swing the walls into an upright position to assemble the container.

Figure 6:
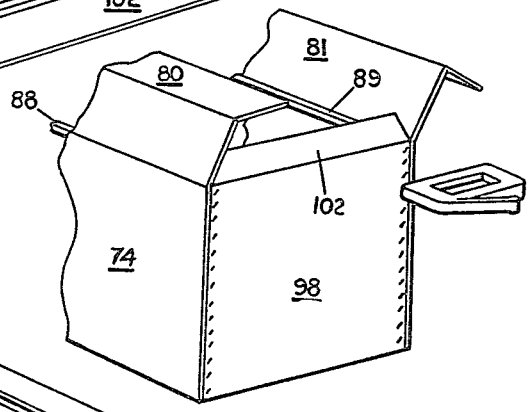
FIG. 6 is a partial perspective view of an end wall of the box in an assembled state showing the attaching of the end wall to the frame structure.
Figure 8:
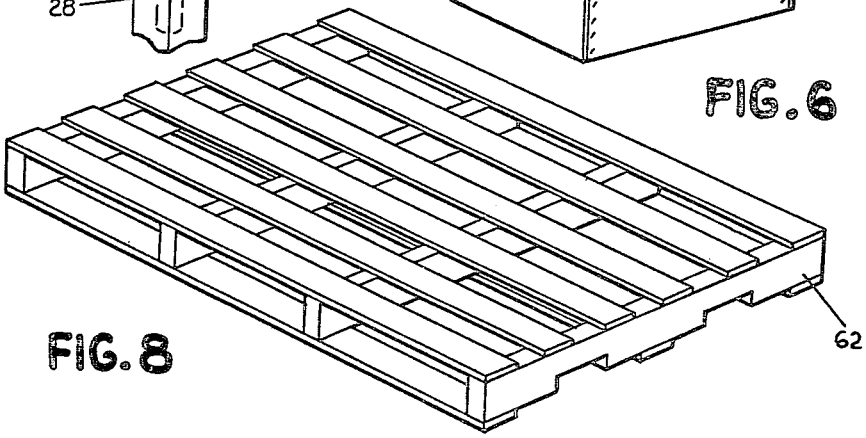
FIG. 8 is a perspective view of the pallet or skid which may form part of the base portion of the container.

The score line 76, 77 provided at the midportion of at least one of the side walls allows for folding of the wall to facilitate loading of the container from the side. Because of the relatively large size of the container, this feature of being able to load from the side is important as it is often difficult to place articles within the container from the top due to the height of the box. When assembling the container, it is desirable to maintain the walls in the upright position by securing them to one another. One method which has been discussed above is to provide locking pins through adjacent reinforcing members as shown in FIG. 7. Another method of securing the walls in place is to drive staples through adjacent reinforcing members. Additionally, the end panels can be stapled directly to the vertical struts provided on the side walls, as shown in FIG. 6.

The score lines provided on the end and side panels facilitate storage of the box by allowing the box to be collapsed to a relatively small height. The double score lines provided on the side panels are spaced to allow the panels to be folded over the base so that the vertical struts are flush against the base. The score lines are typically spaced apart a distance of 2 inches, the width of the reinforcing slats. The end walls can then be folded over the side panels along the score line provided thereon so that the height of the box in the stored position is approximately the combined width of the reinforcing members provided on the end and side panels. Since the reinforcing members are typically formed of slats which are $2 \times 2$ in cross-section the stored height exclusive of the skid is slightly greater than 4 inches. This storage feature allows the box to be continuously reused since minimal storage space is necessary in which to store the box.

The size of the end and side panels as well as the number of supports provided on each can be selected to provide the desired box size and rigidity. The above-described container provides a relatively simple assembled box which has sufficient rigidity to transport heavy articles. In using both vertical and horizontal supports within the box interior and by interlocking these supports, a relatively lightweight yet sturdy container is provided. The collapsibility of the container is not impaired by the reinforcing structure due to the inclusion of the score lines which permit the box to be stored for later use.

Other arrangements and constructions of the box may be provided and are within the scope of the invention. For example, a double-wall container construction may be used to provide a smooth interior for the box. One simple manner of constructing such a container would be to provide a large flap at the top portion of the side and end panels which includes a score line to provide for downward folding over the top horizontal reinforcing member. Another construction would be to place the reinforcing members on the exterior of the container. In this way, a lightweight container which has sufficient rigidity and a smooth interior is provided.

Since such containers are often used for shipping large or bulky objects such as automobile fenders, it may be desirable to partition the interior of the container. A corrugated sheet 110, shown in FIG. 3, may be placed in the box parallel to the base in the slots provided in the vertical struts in the second embodiment, for example, to provide two compartments within the container. The score lines provided along the midportions of the side panels would facilitate such a construction. In such an embodiment the bottom of the container can be loaded and then the central dividing sheet placed into position with the side walls folded down along the central scorelines. The upper section of the side walls can then be folded into an upright position to form the second compartment within the container.

The relative positions of the wooden reinforcing members are also interchangeable. For example, the horizontal brace on the side panels can be placed along the top flap, which is then folded downwardly into place to form the locking arrangement with the members on the end walls. If it is desired to further strengthen the container, horizontal slats may be placed along the base portion of the box. A two-piece box construction may also be provided wherein the side and end panels are formed integrally with each other. In this construction, the container is stored by removing the panels from the base and collapsing them so that the side and end walls overlap the opposite panels.

The foregoing specification and drawings are merely illustrative of the invention and are not intended to limit the invention to a particularly described embodiment. Variations and changes which are obvious to one skilled in the art are intended to be within the scope and nature of the invention which is defined in the appended claims.

The embodiments of the invention in which an exclusive property or privilege is claimed are defined as follows:

1. A folding box comprising:

a base;

a pair of first opposing panels secured to said base, said first panels including a score line adjacent said base and dividing each first panel into a side wall foldable into a generally perpendicular position relative to the base along said score line and a base flap secured to said base;

a pair of second opposing panels, each including a score line adjacent said base and dividing each second panel into a bottom flap overlying the surface of said base and an end wall foldable into a generally perpendicular position relative to the base along said score line;

at least one rigid horizontal reinforcing member secured to each of said end walls, said at least one rigid horizontal reinforcing member having a length equal to that of the end wall;

rigid vertical supports provided along lateral edges of the side walls and secured thereto, said rigid vertical supports each having a bottom surface which seats against the bottom flap of a second panel when the side walls are in an upright position, thereby frictionally holding the second panels on the base;

a rigid brace disposed laterally on each of said side walls adjacent an upper edge thereof and secured thereto for further rigidifying said framework; and means forming a rigid interlocking vertical connection between said at least one rigid horizontal reinforcing member, said laterally-disposed rigid brace and said rigid vertical supports;

whereby said rigid vertical supports, said laterally-disposed rigid brace and said at least one rigid horizontal reinforcing member cooperate, when interlocked, to form a rigid framework for said container and when said vertical supports, said laterally-disposed rigid brace and said rigid horizontal reinforcing member are not interlocked, said score lines permit folding of said side and end walls to a collapsed position, thereby facilitating storage of said container.

2. The folding box of claim 1 wherein said vertical supports and said horizontal brace abut at corner portions of said side walls and an end portion of said horizontal reinforcing member is adjacent said abutting vertical supports and horizontal brace.

3. The folding box of claim 2 wherein said first and second panels are corrugated board.

4. The folding box of claim 1 wherein said horizontal reinforcing member is spaced from an upper edge of said end wall and said laterally-disposed brace and an upper surface of said vertical supports define means for receiving said horizontal reinforcing member in an interlocking relationship.

5. The folding box of claim 4 wherein said means for receiving said horizontal reinforcing member is a slot.

6. The folding box of claim 1 wherein said base is secured on a skid.

7. The folding box of claim 1 wherein said rigid reinforcing member, said rigid vertical supports and said horizontal brace are wood slats.

8. The folding box of claim 1 wherein at least one of said side walls includes a means for folding said panel along a midportion thereof to facilitate loading of the box.

9. The folding box of claim 8 wherein said means for folding is a score line.

10. The folding box of claim 1 wherein said framework further comprises a rigid horizontal reinforcing member arranged midway between the top and bottom edges of said end walls, and interlocked with said vertical supports.

11. The folding box of claim 10 wherein said vertical supports are pairs of vertically-aligned members laterally spaced along said side wall wherein said pairs of vertical members are longitudinally spaced apart to define a slot for receiving said horizontal reinforcing member arranged midway between said top and bottom edges of said end walls in an interlocking relationship.

12. The folding box of claim 1 wherein said means forming a rigid vertical connection includes pin means inserted through adjacent portions of said rigid vertical supports, said rigid brace and said at least one rigid horizontal reinforcing member for securing said side and end walls in said upright position.

13. The folding box of claim 1 wherein each of said first and second panels includes a score line at a top portion thereof defining a top flap which forms a cover for said box.

14. A folding box comprising:

a base;

a pair of first opposing panels secured to said base and pivotally connected thereto to form opposing side walls;

a pair of second opposing panels each including an end wall foldable into an upright portion along a first score line adjacent said base and a bottom flap arranged to overlie a portion of a top surface of said base and secured thereon;

two horizontal support members fixed to each end wall between a top edge thereof and the bottom flap;

a laterally-arranged brace disposed across the upper edge of each first panel;

vertical supports including two axially arranged struts secured to the lateral edges of each first panel and longitudinally spaced apart to define a first slot;

said vertical supports forming a second slot defined by said laterally-arranged brace and a top surface of a strut of said vertical supports; and said horizontal support members received by said first and second slots in an interlocking relationship when the box is assembled;

whereby said interlocked vertical and horizontal supports form a rigid framework for said container and provide for easy assembly of said container.

15. The folding box of claim 14 further comprising a score line provided on at least one of said first panels between the upper and lower edges thereof to permit folding of the panel to assist in loading of the box.

16. The folding box of claim 15 including an intermediate planar surface disposed within the box for dividing said box into at least two compartments.

17. The folding box of claim 14 wherein said base includes a skid adapted for use with a fork lift.

18. The folding box of claim 14 wherein end portions of said laterally-disposed brace, the upper surfaces of said vertical supports adjacent said brace and the portions of the horizontal reinforcing member adjacent said vertical supports include bores for receiving a locking pin for securing said end wall in an upright position.

19. The folding box of claim 14 wherein said end walls are secured in an upright position.

20. The folding box of claim 15 wherein said pair of first panels each include a first score line along which said first panel is pivoted with respect to the base, a second score line spaced from and parallel to the first score line, said second score line spaced at least a distance equal to a width of said vertical supports, and a third score line spaced from and parallel to said second score line, said third score line spaced a distance at least equal to twice a width of the vertical supports, thereby permitting one of said first panels to be collapsed along said second score line and the second of said first panels to be collapsed along said third score line to positions overlying said base.

21. The folding box of claim 20 wherein each of said second panels includes a second score line spaced from said first score line about which said second panel is foldable into an upright position, said second score line spaced from said first score line at least a distance equal to the sum of twice a width of a vertical support and the width of a horizontal support member, whereby said second panel is foldable along said second score line into a collapsed position overlying said side walls and said base.

* * * * *